US011965265B1

(12) United States Patent
Sapiro et al.

(10) Patent No.: US 11,965,265 B1
(45) Date of Patent: Apr. 23, 2024

(54) HYBRID ELECTRO-PROCESSING OF A METAL WORKPIECE

(71) Applicant: The United States of America as Represented by the Secretary of the Navy, Indian Head, MD (US)

(72) Inventors: David Sapiro, King George, VA (US); Gabriel Bjerke, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/873,076

(22) Filed: Jan. 30, 2020

(51) Int. Cl.

| | |
|---|---|
| ***C25F 3/02*** | (2006.01) |
| ***C25D 3/02*** | (2006.01) |
| ***C25D 5/00*** | (2006.01) |
| ***C25D 5/18*** | (2006.01) |
| ***C25D 5/34*** | (2006.01) |
| ***C25D 21/14*** | (2006.01) |

(52) U.S. Cl.
CPC ..... *C25F 3/02* (2013.01); *C25D 3/02* (2013.01); *C25D 5/18* (2013.01); *C25D 5/34* (2013.01); *C25D 21/14* (2013.01); *C25D 5/605* (2020.08)

(58) Field of Classification Search
None
See application file for complete search history.

(56) References Cited

U.S. PATENT DOCUMENTS

| | | | |
|---|---|---|---|
| 3,616,346 | A | 10/1971 | Inoue |
| 3,634,207 | A | 1/1972 | Toledo et al. |
| 5,599,437 | A | 2/1997 | Taylor et al. |
| 5,833,835 | A | 11/1998 | Gimaev |
| 6,203,684 | B1 | 3/2001 | Taylor et al. |
| 6,319,384 | B1 | 11/2001 | Taylor et al. |
| 6,402,931 | B1 | 6/2002 | Zhou et al. |
| 6,558,231 | B1 | 5/2003 | Taylor |
| 6,793,797 | B2 | 9/2004 | Chou et al. |
| 6,878,259 | B2 | 4/2005 | Taylor et al. |
| 2002/0033341 | A1 | 3/2002 | Taylor et al. |
| 2002/0070126 | A1 | 6/2002 | Sato et al. |
| 2003/0178315 | A1 | 9/2003 | Taylor |
| 2011/0017608 | A1 | 1/2011 | Taylor et al. |

(Continued)

FOREIGN PATENT DOCUMENTS

| | | | | |
|---|---|---|---|---|
| GB | 626244 A | * | 4/1947 | ..... C25D 3/40 |
| KR | 20160078556 A | * | 12/2014 | ..... C25D 3/24 |

*Primary Examiner* — Louis J Rufo

(74) *Attorney, Agent, or Firm* — Fredric J. Zimmerman

(57) ABSTRACT

An in-situ method for changing surface features of a metal workpiece. An electrically conductive workpiece is immersed in a bath containing an electrolyte solution devoid of ions corresponding to the workpiece. A counter electrode is immersed in the bath. An electric power supply is connected to the workpiece and the counter electrode. An electric current is passed in a first direction between the workpiece and the counter electrode, while the workpiece serves as an anode. The electric current polarity is reversed to pass the electric current in a second direction between the metallic workpiece and the electrode, while the workpiece serves as a cathode. The electric current polarity in the first direction drives ions from the workpiece into the electrolyte solution, and the electric current polarity in the second direction plates the ions onto the workpiece in the same bath.

33 Claims, 4 Drawing Sheets

(56) References Cited

U.S. PATENT DOCUMENTS

| | | | | |
|---|---|---|---|---|
| 2015/0147586 | A1* | 5/2015 | De Strycker | C25D 3/665<br>428/610 |
| 2016/0362810 | A1 | 12/2016 | Trimmer et al. | |
| 2019/0345628 | A1* | 11/2019 | Hansal | C25F 3/20 |
| 2020/0318253 | A1* | 10/2020 | Hall | C25F 3/16 |
| 2021/0130973 | A1* | 5/2021 | Lu | C25D 5/18 |

* cited by examiner

HYBRID ELECTRO-PROCESSING OF A METAL WORKPIECE

ORIGIN OF THE INVENTION

The invention described herein was made in the performance of official duties by employees of the Department of the Navy and may be manufactured, used, licensed by or for the Government for any governmental purpose without payment of any royalties thereon.

BACKGROUND

Field of the Invention

This invention is related to an in-situ system and method for electro-etching and electro-plating a metal workpiece in a single electrolytic solution by switching current polarities.

Description of the Background

Hard, high strength metals and alloys have come to be widely used in industry because of their favorable mechanical properties. Such alloys are useful, and even essential, for fabricating mechanical parts that have the mechanical strength and resistance to wear and corrosion that are required in modern industrial practice. Dies for manufacturing metal parts in the automobile and aircraft industries, parts for aircraft and aerospace vehicles, and parts for machine tools are typical uses to which these alloys have been applied. However, the hardness, wear resistance, and passivity of these metals and alloys that make them so useful also cause them to be very difficult and expensive to shape by conventional machining methods. Traditional manufacturing methods typically involve a material being carved or shaped into a desired product by portions of the material being removed in a variety of ways. Still, some complex geometries cannot typically be formed using traditional methods.

Additive manufacturing is a process of joining materials to make objects, as opposed to subtractive manufacturing methods. For example, in additive manufacturing, structures can be made by the addition of thousands of minuscule layers, usually layer upon layer, that combine to create the desired product. Additive manufacturing can help reduce the time for design, prototyping, and manufacturing, while avoiding costly errors and enhancing product quality. However, additive manufacturing tends to leave a poor surface finish, which is detrimental to mechanical properties and corrosion resistance.

Traditional methods to decrease surface roughness include cutting, abrasion, etching, and plating. Cutting and abrasion are optimized for external features and simple internal features. Neither are optimized for the complex geometries that warrant additive manufacturing techniques.

One method to improve surface finish is electro-plating, which can be used to deposit a thin layer of copper, nickel, or other appropriate metal on the surface of a product, such as a large semiconductor wafer preparatory to forming electrical interconnections by the customary masking and etching procedures. However, because of the tendency of electro-plating procedures to deposit excess metal at the edges of the wafer, it has proved difficult to prepare perfectly uniform layers of the plated metal. In some cases, auxiliary electrodes have been used to surround the edges of the wafer in order to provide a uniform electric field.

Electrochemical machining, which is an etching technique, is often characterized as "reverse electro-plating", in that it removes material instead of adding it. During electrochemical machining, metal is dissolved from a workpiece with direct current at a controlled rate in an electrolytic bath. The workpiece serves as the anode and is separated by a gap from a counter electrode, which serves as the cathode. Typically, an electrolyte solution, usually a salt solution in water, is pumped through the gap, flushing away metal dissolved from the workpiece. In alternate but related conventional processes, the charges or current(s) is often pulsed in an on/off action in rapid succession at a fixed polarity, that is, there is not a switching of polarities in a rapid succession.

Etching (including electro-etching/electro-polishing/electrochemical machining) may be used on complex parts and internal structures. An electrolyte solution, usually an acid, dissolves metal on the surface, and can preferentially attack high spots. While this decreases surface roughness, it can also exacerbate surface porosity and leave residual acid in deep pores. Plating (including electro-plating) is very similar to etching, except in the opposite direction. Rather than dissolving metal or metal salts, metal ions in the electrolyte solution condense onto the workpiece. Plating preferentially fills crevices, allowing the plating metal to fill pores, preventing retained electrolyte solution after cleaning. However, when considering additively manufactured metals, undesired materials may become trapped. Plating also usually requires a second metal with which to plate, such as chromium plating on steel.

SUMMARY

Conventional technologies attempt to optimize a solution, voltage, and current to either plate or etch. However, current methods cannot perform both electropolishing and electroplating within the same electrolytic solution, that is, in-situ processing, while switching polarities of the current. The invention described herein discloses a process that has been optimized and designed to hybridize the plating and etching processes, specifically to improve the surface conditions of additively manufactured metals that have unique surface characteristics due to the manufacturing process.

In an aspect of the invention, parts to be processed may be immersed in a bath containing an electrolyte solution and an electric potential is applied, initiating an electro-etching process. The polarization of the electric potential is reversed, to initiate electro-plating. Polarization may be reversed periodically to switch between electro-etching and electroplating without removal of the parts from the bath containing the electrolyte solution, that is, an in-situ process. The time and voltage of each plating and etching stage may be optimized to decrease surface roughness more quickly while using fewer processes than etching or plating alone. Generally, the process starts a first cycle with etching (+) to add metal to the electrolyte, then the polarity is switched to plating (−). Afterwards, a second cycle can begin with etching then plating. In an exemplary embodiment, the etching portion of the first cycle may be longer that etching in later cycles. It is an aspect of the invention that the electro-processing also results in plated metal of the same composition as the base metal of the workpiece.

According to aspects of the disclosed invention, hybrid electro-processing is able to decrease surface roughness of additively manufactured parts. This in-situ process is faster than etching or plating alone and allows the individual processes to be implemented in tandem without using a costly multi-step process. By combining electro-etching and electro-plating in this novel way, cost is reduced in the form of less overall processing time, less consumable materials cost, and lower maintenance cost in production per part processed. The plated material is also similar in composition to the base metal, resulting in more consistent material properties.

According to an aspect of the invention, a process for electro-processing a workpiece includes first electro-etching the workpiece in a bath containing an electrolyte solution with the workpiece being connected as an anode. The electrolyte solution is initially devoid of ions corresponding to the workpiece. In an exemplary embodiment, the workpiece is a three (3) dimensional printed piece of metal. The electro-etching drives ions from the workpiece into the electrolyte solution. Then, electro-plating the ions onto the workpiece in the same bath with the workpiece being connected as a cathode. Thus, this process uses a single solution for plating and etching where the solution uses a piece of metal but does not originally use some sort of metal salt (or source of metal ions) in solution.

According to an exemplary method for electro-processing a workpiece herein, a workpiece and an electrode are provided. A bath containing an electrolyte solution is provided between the workpiece and the electrode. The electrolyte solution is in contact with the workpiece and the electrode. Initially, the electrolyte solution is devoid of ions corresponding to the workpiece. In a first step, an electric current is passed in a first direction between the workpiece and the electrode, wherein the workpiece is maintained anodic with respect to the electrode. In a second step, the electric current is reversed to pass the electric current in a second direction between the workpiece and the electrode, wherein the metallic workpiece is maintained cathodic with respect to the electrode. Generally, and in an exemplary embodiment, the process starts a first cycle with etching (+) to add metal to the electrolyte, then the polarity is switched to plating (−). Afterwards, a second cycle can begin with etching then plating. In an exemplary embodiment, the etching portion of the first cycle may be longer that etching in later cycles.

According to an exemplary method for changing surface features of a workpiece herein, a workpiece is immersed in a bath containing an electrolyte solution devoid of ions corresponding to the workpiece. The workpiece is electrically conductive. A counter electrode is immersed in the bath. An electric power supply is connected to the workpiece and the counter electrode. An electric current is passed in a first direction between the workpiece and the counter electrode while the workpiece serves as an anode. The electric current is reversed to pass the electric current in a second direction between the workpiece and the counter electrode while the workpiece serves as a cathode. The electric current in the first direction drives ions from the workpiece into the electrolyte solution and the electric current in the second direction plates the ions onto the workpiece in the same bath. Generally, multiple cycles of etching and plating are performed within one hour otherwise corrosion forms on the surface.

DETAILED DESCRIPTION OF EXEMPLARY EMBODIMENTS

This disclosure relates to a process, including novel parameters, that changes the surface features of metal via electro-plating and electro-polishing. Parts to be processed are immersed in an electrolyte solution and an electric potential is applied, initiating the electro-etching process. The polarization of the electric potential is reversed, to initiate electro-plating. Polarization is reversed periodically to switch between electro-etching and electro-plating without removal of the parts from the electrolyte solution. The time and voltage of each plating and etching stage is optimized to decrease surface roughness more quickly and using fewer processes than etching or plating alone. It also results in plated metal of the same composition as the base metal. This in-situ process is faster than etching or plating alone and allows the individual processes to be implemented in tandem without using a costly multi-step process. By combining electro-etching and electro-plating in this novel way, cost is reduced in the form of less overall processing time, less consumable materials cost, and lower maintenance cost in production per part processed. The plated material is also similar in composition to the base metal, resulting in more consistent material properties. As indicated, this process uses a single solution for plating and etching where the solution uses a piece of metal but does not originally use some sort of metal salt (or source of metal ions) in solution, which is also beneficial from a usage perspective. Generally, and in an exemplary embodiment, the process starts a first cycle with etching (+) to add metal to the electrolyte, then the polarity is switched to plating (−). Afterwards, a second cycle can begin with etching then plating. In an exemplary embodiment, the etching portion of the first cycle may be longer that etching in later cycles.

Figure 1:
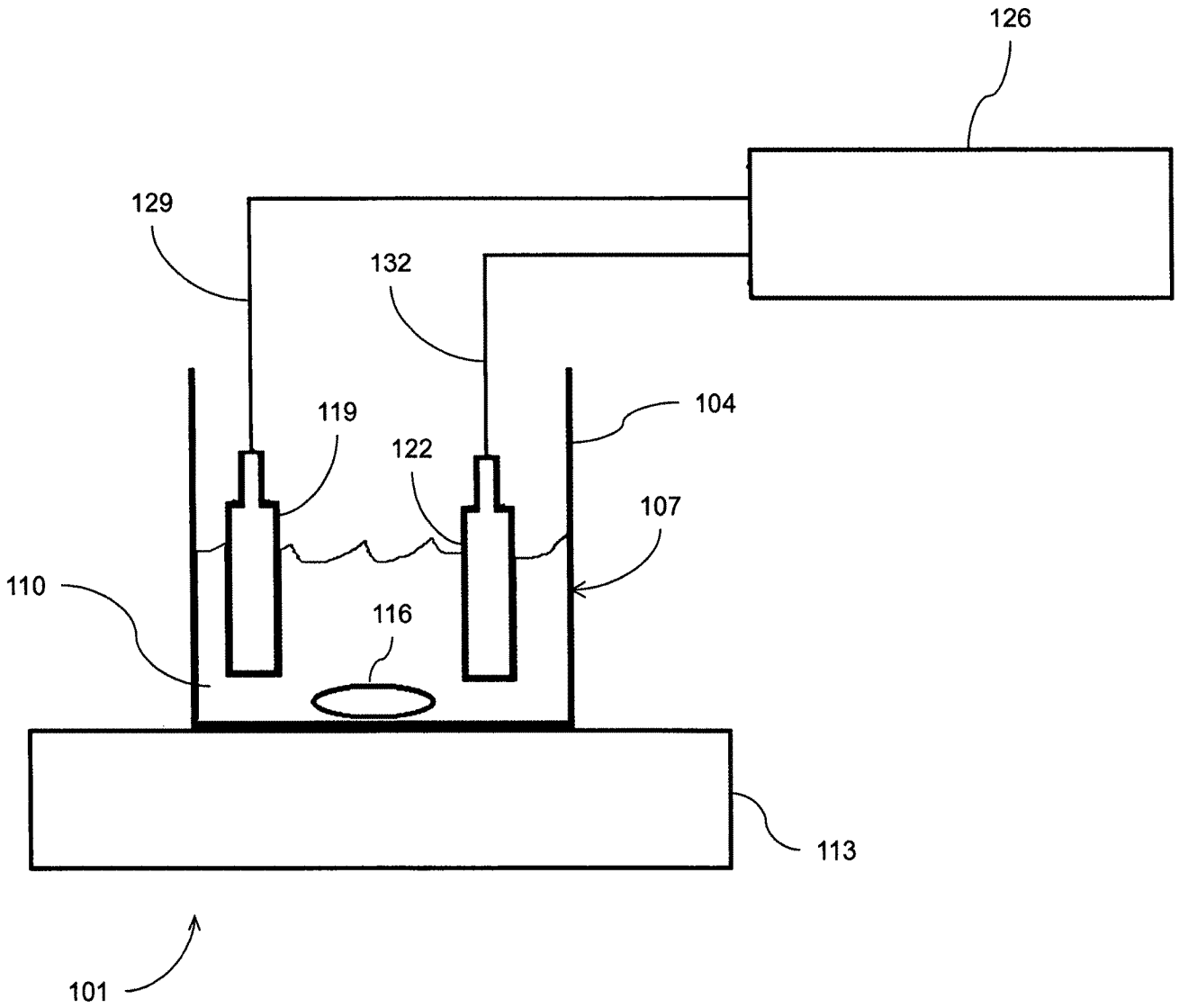
FIG. 1 shows an exemplary system for electro-processing of a metal workpiece according to devices and methods herein.

Referring now to the drawings, FIG. 1 shows a system, indicated generally as 101, for electro-processing of a metal workpiece, according to systems and methods herein. The system 101 includes a vessel 104 containing a bath 107. The bath 107 is made of an electrolyte solution 110. The vessel 104 may be resting on a magnetic stirring unit 113. A magnetic stir bar 116 (broadly "magnetic bar") may be included within the vessel 104 for directly stirring/mixing (broadly "moving" or "agitating") the electrolyte solution 110 in the vessel 104. As is known in the art, the stir bar 116 may be positioned at a bottom part of the vessel 104 and is rotatably driven, or spun, on the bottom surface of the vessel 104 by the magnetic stirring unit 113 to mix materials, such as the electrolyte solution 110 in the vessel 104. A rotating magnetic field in the magnetic stirring unit 113 causes the stir bar 116 immersed in the bath 107 to spin, thus stirring the electrolyte solution 110. In an exemplary embodiment, the stir bar stirs at 275 RPM. It is to be understood that the stir bar 116 could be positioned differently in the vessel 104 for mixing materials within the scope of the invention. For example, it could be elevated above the bottom part of the vessel 104 or it could be offset from a center of the vessel 104.

A workpiece 119 may be immersed in the bath 107, such that the electrolyte solution 110 is in contact with the workpiece 119. A counter electrode 122 may also be immersed in the bath 107, such that the electrolyte solution 110 is in contact with the counter electrode 122. The workpiece 119 may be essentially metal, made of an electro-dissolvable substance, such as copper, gold, silver, nickel, and combinations thereof. Other appropriate electro-dissolvable materials may be used. The counter electrode 122 may be made of any appropriate conductor, for example a non-consumable piece, such as lead or carbon.

The workpiece 119 and the counter electrode 122 may be connected to a power supply 126 using appropriate electrical leads, such as wires 129, 132, attached to the workpiece 119 and counter electrode 122, respectively. The power supply 126 may include a power storage element (e.g., a battery) and may be connected to an external power source (not shown), such as an alternating current (AC) power source, through the power supply 126. The power supply 126 may convert the electrical power from the external power source into the type of power needed, for example, direct current (DC) power. As would be known by one of ordinary skill in the art, an electrolyte is a substance that produces an electrically conductive solution when dissolved in a solvent, such as water. The dissolved electrolyte separates into cations and anions, which disperse uniformly through the solvent. Electrically, such a solution is neutral, however if an electric potential is applied to such a solution, the cations of the solution are drawn to the electrode that has an abundance of electrons, while the anions are drawn to the electrode that has a deficit of electrons. The movement of anions and cations in opposite directions within the solution amounts to an electric current.

According to systems and methods herein, the electrolyte solution 110 can include most soluble salts, acids, and bases and is initially devoid of ions corresponding to the workpiece 119. For example, the electrolyte solution 110 may comprise a liquid comprising a base or a liquid comprising an acid. Sodium, potassium, chloride, calcium, magnesium, and phosphate are examples of electrolytes that can be dissolved in solution, which electrolyte solution can be selected from the group consisting of sodium nitrate, sodium chloride, and mixtures of sodium nitrate and sodium chloride. Some electrolyte solutions are often concentrated acid solutions having a high viscosity, such as mixtures of sulfuric acid and phosphoric acid. Other electrolyte solutions may include mixtures of perchloric acid with acetic anhydride, and methanolic solutions of sulfuric acid. When electrodes, such as workpiece 119 and counter electrode 122, are placed in an electrolyte solution 110 and a voltage is applied, the electrolyte solution 110 will conduct electricity. In exemplary embodiments, The solution chemistry, in exemplary embodiments, may include combinations of acids including sulfuric acid, phosphoric acid, nitric acid, hydrochloric acid, hydrofluoric acid, acetic acid, in methyl or ethyl alcohol or water. Further, the solution chemistry, in exemplary embodiments, may include combinations of bases including sodium hydroxide, zirconium hydrochloride, hydrogen peroxide, ammonia, in methyl, ethyl, or butyl alcohol or water. In a specific exemplary embodiment, the solution chemistry may include 50% sulfuric/50% phosphoric acids.

In practice, a workpiece 119 to be processed may be immersed in the bath 107 and an electric potential applied from the power supply 126 to initiate an electro-etching process. Electro-etching is an electrochemical process that removes material from the workpiece 119, reducing the surface roughness, and driving ions from the workpiece 119 into the electrolyte solution 110. In other words, the workpiece 119 is immersed in the bath 107 and serves as the anode. That is, the workpiece 119 is connected to the positive terminal of the power supply 126, the negative terminal being attached to the counter electrode 122, which serves as the cathode. A current passes from the anode (workpiece 119) to the cathode (counter electrode 122). Metal on the surface of the workpiece 119 is oxidized and dissolved in the electrolyte solution 110. At the cathode, a reduction reaction occurs, which normally produces hydrogen. Electro-etching, sometimes referred to as electropolishing, is the process that uses the electric current to remove metal cations from the surface of the workpiece 119 and may be thought of as the opposite of electro-plating. According to systems and methods herein, without removing the workpiece 119 from the vessel 104, the polarization of the electric potential applied from the power supply 126 is reversed, to initiate electro-plating. In an exemplary embodiment, the voltage range is −5 V thru +5V (−/+5 V). In another exemplary embodiment, the system/method also maybe controlled by using current/current density where voltage would not be a controlled variable. The current/current density may, in an exemplary embodiment, be in a range of −1 mA/cm^2-1 A/cm^2.

Electro-plating is an electrochemical process that uses the electric current to reduce dissolved metal cations from the electrolyte solution 110 so that they form a thin coherent metal coating on the workpiece 119. The part to be plated (i.e., the workpiece 119) is now the cathode of the circuit and the counter electrode 122 is now the anode. Both the workpiece 119 and the counter electrode 122 remain immersed in the electrolyte solution 110. In an exemplary embodiment, the method, including the electrolytic solution, is may be performed in a temperature range of ambient (room) temperature thru 150 degrees Celsius (ambient-150 degrees Celsius). The power supply 126 supplies a direct current to the anode (counter electrode 122). At the cathode (workpiece 119), the dissolved metal ions in the electrolyte solution 110 are reduced at the interface between the solution and the cathode (workpiece 119), such that they "plate out" onto the workpiece 119. The counter electrode 122 is non-consumable, such as lead or carbon, which, in this case, serves as the anode. Ions of the metal to be plated come solely from the workpiece 119 in the electro-etching process so they can then be drawn out of the electrolyte solution 110 and plated back on the workpiece 119. In this manner, the electro-processing (i.e., electro-etching and electro-polishing) results in plated metal being the same composition as the base metal of the workpiece 119. Accordingly, this process uses a single solution for plating and etching not multiple solutions of metal salts or dissolved powdered metal.

Polarization of the power supply 126 may be reversed periodically to switch between electro-etching and electro-plating without removal of the workpiece 119 and counter electrode 122 from the bath 107 containing the electrolyte solution 110. The time and voltage of each plating and etching stage may be optimized to decrease surface roughness more quickly while using fewer processes than etching or plating alone. The processing of the workpiece 119 causes levelling of micro-peaks and valleys, improving the surface finish of the workpiece 119. Such processing can be used to polish, passivate, and deburr the workpiece 119, which may be used in lieu of abrasive fine polishing in microstructural preparation. Again, this process switches the polarity of the electric current in rapid succession but does not use conventional "pulse" technology where typically the current is turned off/on in rapid succession.

Figure 2:
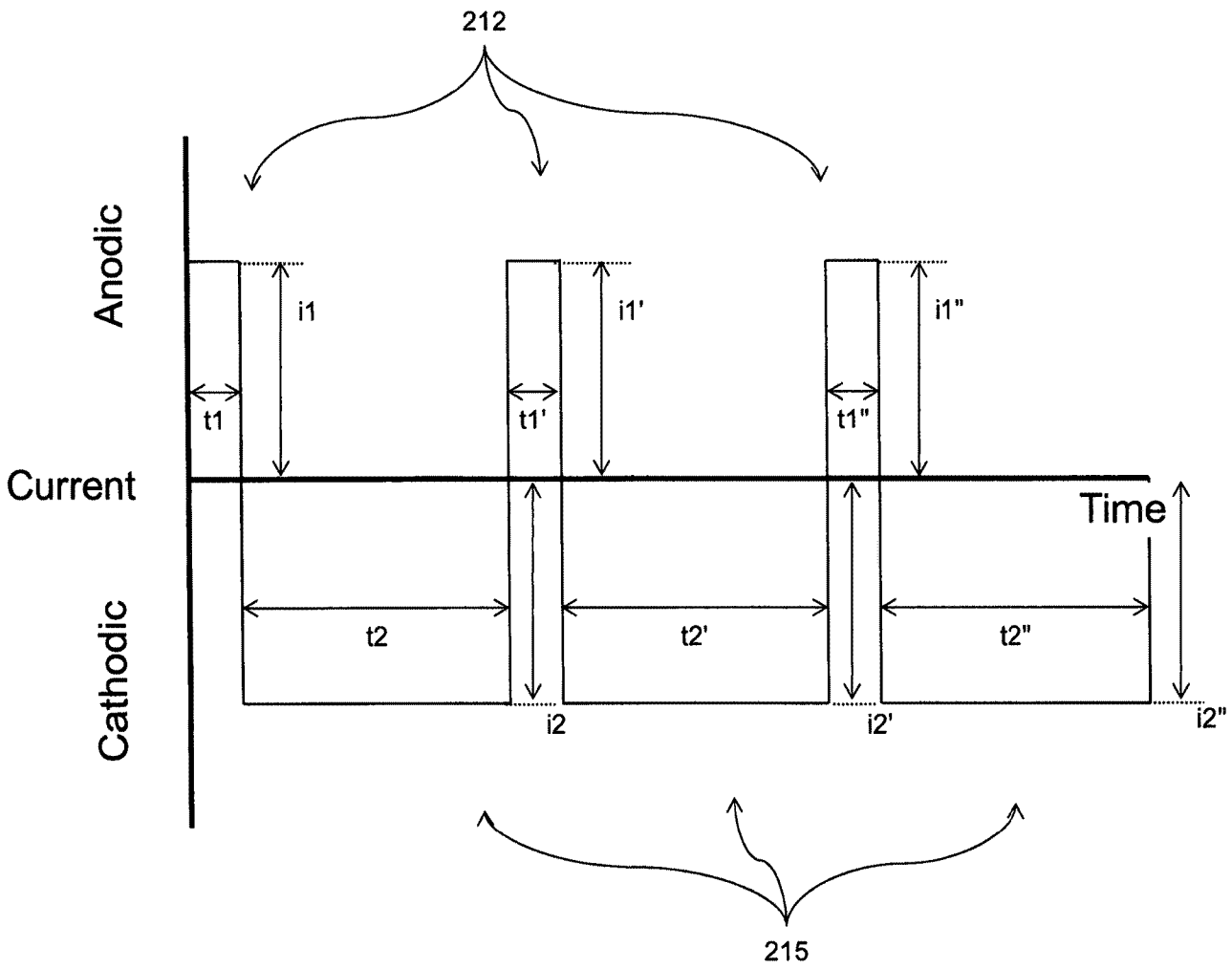
FIG. 2 shows a schematic diagram of a current wave form of the type used according to devices and methods herein.

According to systems and methods herein, the electro-etching and electro-plating processes can be continuously repeated for an undetermined number of cycles. Generally, in an exemplary embodiment, the process starts a first cycle with etching (+) to add metal to the electrolyte, then the polarity is switched to plating (−). Afterwards, a second cycle can begin with etching then plating. In an exemplary embodiment, the etching portion of the first cycle may be longer that etching in later cycles. FIG. 2 illustrates schematically a square wave of current (or voltage) used in the disclosed method. An etching current i1 is turned on for a first period of time t1, causing the workpiece 119 to serve as the anode. The etching current i1 is a DC current provided by the power supply 126 that is flowing in a first direction between the workpiece 119 and the counter electrode 122. After the first period of time t1, the polarization of the power supply 126 is reversed to switch between electro-etching and electro-plating without removal of the workpiece 119 and counter electrode 122 from the bath 107 containing the electrolyte solution 110. A plating current i2 is turned on for a second period of time t2, causing the workpiece 119 to serve as the cathode. The plating current i2 is a DC current provided by the power supply 126 that is flowing in a second direction between the workpiece 119 and the counter electrode 122. The process can be cyclically repeated with one or more electro-etching stages 212 followed by one or more electro-plating stages 215. It is not necessary that each electro-etching stage 212 be at the same etching current i1 or same first time period t1. In other words, as shown in FIG. 2, t1 need not equal t1' need not equal t1" and i1 need not equal i1' need not equal i1". Similarly, t2 need not equal t2' need not equal t2" and i2 need not equal i2' need not equal i2". According to systems and methods herein, in exemplary embodiments, etching time to plating times may be in a range of one (1) second for plating-ten (10) minutes for plating. In another exemplary embodiment, the first period of time t1 for the etching current i1 may be up to approximately 1 minute. Further, according to systems and methods herein, the second period of time t2 for the plating current i2 may be up to approximately 10 minutes. Other exemplary cycle times can be used; for example, 1 minute for both etching and plating, 5 minutes for both etching and plating, or less than 1 minute for etching and 5 minutes for plating.

Figure 3:
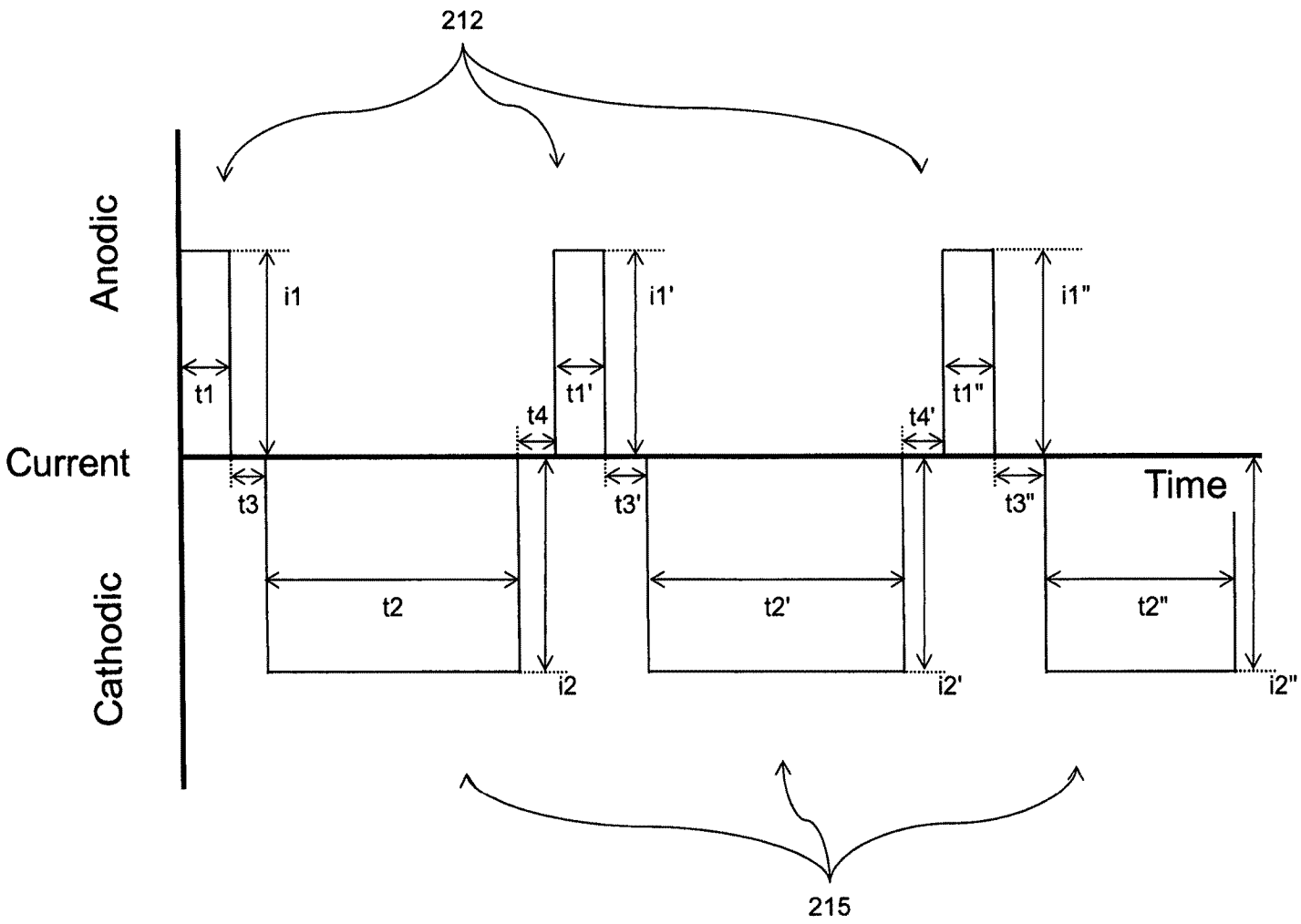
FIG. 3 shows another schematic diagram of a current wave form of the type used according to devices and methods herein.

Referring to FIG. 3, each of the one or more electro-etching stages 212 can be followed by an interval of no electric current flow for a period of time t3 called the off-time. It is not necessary that the off-time be the same for each electro-etching stage 212. In other words, as shown in FIG. 3, t3 need not equal t3' need not equal t3". Similarly, each of the one or more electro-plating stages 215 can be followed by an interval of no electric current flow for a period of time t4 called the rest-time. It is not necessary that the rest-time be the same for each electro-plating stage 215. In other words, as shown in FIG. 3, t4 need not equal t4'.

Figure 4:
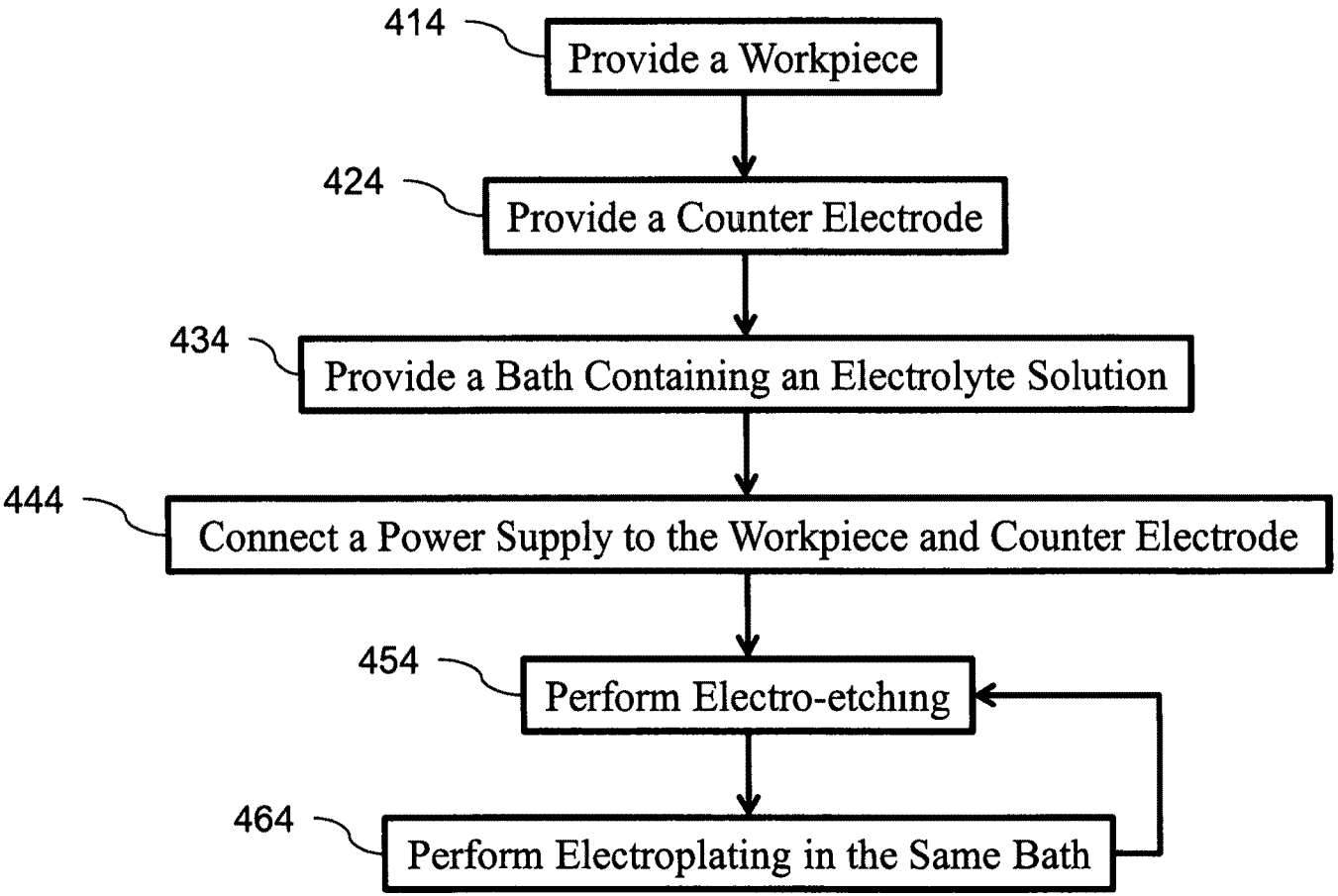
FIG. 4 is a flow chart illustrating methods herein.

Actual Process Example. FIG. 4 is a flow chart illustrating a specific embodiment of the invention herein. At 414, a workpiece was provided. The workpiece was made of metal selected from the group consisting of copper, gold, silver, nickel, and combinations thereof.

At 424, an electrode was provided.

At 434, a bath containing an electrolyte solution was provided between the workpiece and the electrode, such that the workpiece and the electrode were immersed in the electrolyte solution. Initially, the electrolyte solution was devoid of ions corresponding to the workpiece. The electrolyte solution may be a liquid that is a base or a liquid that is an acid. For example, the electrolyte solution was selected from the group consisting of sodium nitrate, sodium chloride, and mixtures of sodium nitrate and sodium chloride, as well as sulfuric acid and phosphoric acid. The electrolyte solution was in contact with the metallic workpiece and the electrode.

At 444, an electric power supply was connected to the workpiece and the electrode.

At 454, electro-etching was performed by passing an electric current in a first direction between the workpiece and the electrode while the workpiece served as an anode. The electric current in the first direction drove ions from the workpiece into the electrolyte solution.

At 464, electro-plating was performed. The electric current was reversed to pass the electric current in a second direction between the metallic workpiece and the electrode while the workpiece served as a cathode. The electric current in the second direction plated the ions onto the workpiece in the same bath. The instant, actual process was performed where the time of etching was one (1) minute and the plating time was ten (10) minutes, that is, a 1:10 ratio. The electrolytic solution was operating from about 65-about 75 degrees Celsius (65-75 degrees Celsius) with a stir bar set at 275 RPM. The electrolytic solution was a fifty-fifty (50:50) mixture of sulfuric acid and phosphoric acid, that is, a single solution was used for both the plating and the etching not multiple solutions. The voltage range was −/+5V (volts) where the plating was performed at −5V, and the etching was performed at +5V, that is, with switching polarities in succession. As indicated, etching was performed before the plating step.

Then, repeated cycles of electro-etching and electro-plating can be performed without removing the workpiece from the bath where the polarities are switched in rapid succession not pulsed off and on. Testing indicates that multiple cycles of etching and plating need to be performed within one hour otherwise corrosion is formed on the surface, that is, if the workpiece (sample) sits in the electrolytic solution too long than the workpiece will begin to corrode.

The disclosed invention provides a hybrid electro-processing method that is able to decrease surface roughness of additively manufactured parts. This process is faster than etching or plating alone and allows the individual processes (i.e., electro-etching and electro-plating) to be implemented in tandem without using a costly multi-step process. By combining electro-etching and electro-plating in this novel way, cost is reduced in the form of less overall processing time, less consumable materials cost, and lower maintenance cost in production per part processed. The plated material is also similar in composition to the base metal, resulting in more consistent material properties.

Some of the advantages of the invention include creation of a clean, smooth surface. The disclosed process can polish areas that are inaccessible by other polishing methods. The electro-etching removes a small amount of material (generally 20-40 microns in depth) from the surface of the workpiece, while also removing small burrs or high spots. It can be used to reduce the size of parts when necessary. Further, the electro-plating deposits exactly the same type of material to the workpiece.

The invention has been described with reference to specific exemplary embodiments. While particular values, relationships, materials, and steps have been set forth for purposes of describing concepts of the invention, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present invention, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present exemplary embodiments are to be considered in all respects as illustrative and not restrictive.

The terminology used herein is for the purpose of describing particular systems and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various embodiments herein have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

For example, terms such as "right", "left", "vertical", "horizontal", "top", "bottom", "upper", "lower", "under", "below", "underlying", "over", "overlying", "parallel", "perpendicular", etc., as used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A process for electro-processing a workpiece, comprising:

electro-etching said workpiece in a bath containing a first solution being an electrically neutral solution, wherein said workpiece is connected to a power supply as an anode, wherein the power supply generates an electric current, wherein said first solution is initially devoid of ions corresponding to the workpiece as the ions are generated during the process, and said electro-etching drives the ions from said workpiece into said first solution and then electro-plating said ions back onto said workpiece in the same bath with said workpiece being connected to said power supply and acting as a cathode when a polarity of an electric current is reversed; and a counter electrode being connected to the power supply, wherein repeated cycles of said electro-etching and said electroplating are performed in an in-situ process where polarities are switched in rapid succession, wherein the process uses anodic voltages and cathodic voltages where the anodic voltages are positive voltages and the cathodic voltages are negative voltages, wherein the electro-etching is performed using said anodic voltages, and wherein the electric current is reversed so that the electroplating is performed using said cathodic voltages.

2. The process according to claim 1, wherein said workpiece is comprised essentially of metal.

3. The process according to claim 2, wherein said workpiece comprises an electro-dissolvable metal.

4. The method according to claim 2, wherein the metal used for the electro-plating is a same material and a same composition as the metal of the work piece used for the electro-etching.

5. The process according to claim 1, wherein said first solution comprises a liquid selected from one of a base and an acid.

6. The process according to claim 1, further comprising cyclically electro-etching and electro-plating said workpiece.

7. The process according to claim 6, wherein cycles of electro-etching and electro-plating said workpiece are performed without removing said workpiece from said bath.

8. The process according to claim 1, wherein the first solution is initially devoid of said ions, and wherein the ions are metal ions generated during the process.

9. The process according to claim 1, wherein the first solution is a carrier of the ions generated by at least one of the workpiece and the counter-electrode.

10. The process according to claim 1, wherein the workpieces are the electrodes.

11. The process according to claim 1, wherein the counter electrode is a non-consumable counter electrode.

12. The method according to claim 1, wherein the first solution is a non-metallic ion based, first solution.

13. The method according to claim 1, wherein the first solution is comprised of an acidic solution.

14. The method according to claim 1, wherein the first solution is comprised of sulfuric acid and phosphoric acid.

15. The method according to claim 1, wherein all of the moieties plated in the method come from the workpiece.

16. The method according to claim 1, wherein the electro-etching is performed at a first electric current of +5V, and wherein the electro-plating is performed at a second electric current of −5V.

17. The method according to claim 1, wherein the workpiece comprise a first composition, which is a same said first composition of said ions plated back onto said workpiece.

18. The method according to claim, 1, wherein said method produces said workpiece geometrically optimized for additive manufacturing metals and techniques.

19. A method for electro-processing a workpiece, the method comprising:

providing a workpiece;

providing an electrode; and providing a bath containing a first solution being an electrically neutral solution devoid of ions between said workpiece and said electrode, said first solution being in contact with said workpiece and said electrode, wherein said first solution is devoid of ions corresponding to said workpiece as the ions are generated during the electro-processing;

in a first step, passing an electric current in a first direction between said workpiece and said electrode, wherein said workpiece is maintained anodic with respect to said electrode, and in a second step, reversing said electric current to pass said electric current in a second direction between said workpiece and said electrode, wherein said workpiece is maintained cathodic with respect to said electrode, wherein repeated cycles of said first step and said second step are performed in an in-situ process where polarities are switched in rapid succession, wherein the method uses anodic voltages and cathodic voltages where the anodic voltages are positive voltages and the cathodic voltages are negative voltages, wherein the first step is performed using said anodic voltages, and wherein the electric current is reversed so that the second step is performed using said cathodic voltages.

20. The method for electro-processing a workpiece according to claim 19, wherein said workpiece is comprised essentially of metal.

21. The method for electro-processing a workpiece according to claim 20, wherein said workpiece comprises an electro-dissolvable metal.

22. The method for electro-processing a workpiece according to claim 19, wherein said first solution comprises a liquid selected from one of a base and an acid.

23. The method for electro-processing a workpiece according to claim 19, wherein said first step drives ions from said workpiece into said first solution.

24. The method for electro-processing a workpiece according to claim 23, wherein said second step plates said ions onto said workpiece.

25. The method for electro-processing a workpiece according to claim 19, further comprising cyclically repeating said first step and said second step.

26. The method for electro-processing a workpiece according to claim 25, wherein cycles of said first step and said second step are performed without removing said workpiece from said bath.

27. A method for changing surface features of a workpiece, comprising:

immersing a workpiece in a bath containing a first solution being an electrically neutral solution, said first solution being devoid of ions corresponding to said workpiece as the ions are generated during an application of an electric current to the workpiece, said workpiece being electrically conductive;

immersing a counter electrode in said bath;

connecting an electric power supply to said workpiece and said counter electrode;

passing the electric current in a first direction between said workpiece and said counter electrode, said workpiece serving as an anode; and reversing said electric current to pass said electric current in a second direction between said workpiece and said counter electrode, said workpiece serving as a cathode, wherein said electric current in said first direction drives ions from said workpiece into said first solution and said electric current in said second direction plates said ions onto said workpiece in the same bath, wherein repeated cycles of said passing the electric current in said first direction and said reversing the current to pass the electric current in said second direction are performed in an in-situ process where polarities are switched in rapid succession, wherein the method uses anodic voltages and cathodic voltages where the anodic voltages are positive voltages and the cathodic voltages are negative voltages, wherein the passing the electric in the first direction is performed using said anodic voltages, and wherein the electric current is reversed so that the electric current is passed in said second direction is performed using said cathodic voltages.

28. The method according to claim 27, wherein said workpiece comprises an electro-dissolvable metal.

29. The method according to claim 27, wherein said first solution comprises a liquid selected from one of a base and an acid.

30. The method according to claim 27, further comprising cyclically repeating said passing said electric current in said first direction between said workpiece and said counter electrode and said reversing said electric current to pass said electric current in said second direction between said workpiece and said counter electrode.

31. The method according to claim 30, wherein cycles of said electric current in said first direction and said electric current in said second direction are performed without removing said workpiece from said bath.

32. The method according to claim 30, wherein an interval of no electric current flow is interposed between said passing said electric current in said first direction and succeeding passing said electric current in said second direction.

33. The method according to claim 30, wherein said cyclically repeating said passing and said reversing is performed within one hour.

* * * * *